United States Patent [19]

Mualem

[11] Patent Number: 4,545,164

[45] Date of Patent: Oct. 8, 1985

[54] WALL SPACER

[76] Inventor: Charles W. Mualem, 12 Woodstone Dr., New Berlin, N.J. 08009

[21] Appl. No.: 490,386

[22] Filed: May 2, 1983

[51] Int. Cl.[4] ..... E04B 1/74

[52] U.S. Cl. ..... 52/404; 52/562; 411/347

[58] Field of Search ..... 52/404, 462, 562; 248/359 B, 216.1, 546; 411/21, 347, 348, 351; 220/445; 249/216, 38, 42, 43, 45, 40

[56] References Cited

U.S. PATENT DOCUMENTS

| | | | |
|---|---|---|---|
| 1,950,205 | 3/1934 | Young | 411/508 |
| 3,561,516 | 2/1971 | Reddy | 411/347 |
| 3,906,693 | 9/1975 | Todorovic | 52/404 |
| 4,174,596 | 11/1979 | Deibele | 52/404 |

FOREIGN PATENT DOCUMENTS

| | | | |
|---|---|---|---|
| 2201058 | 7/1973 | Fed. Rep. of Germany | 411/347 |
| 481541 | 3/1938 | United Kingdom | 411/351 |

*Primary Examiner*—John E. Murtagh
*Assistant Examiner*—Kathryn Ford
*Attorney, Agent, or Firm*—James L. Kirschnik

[57] ABSTRACT

A spacer device for use in construction of conventional walls to permit increased wall thicknesses and use of additional insulating materials. The spacer comprises a hollow cylinder having spring biased pins extending chordally from the sides of the cylinder. The pins may be compressed against the springs and into the cylinder to permit insertion of the spacer device through apertures in a wall panel. After insertion, the springs force the pins outward to act as a positive stop against axial movement of the panel along the cylinder.

2 Claims, 3 Drawing Figures

WALL SPACER

SUMMARY OF THE INVENTION

The present invention basically comprises a spacing device for fastening exterior sheathing to conventional wall studs used in home construction so as to hold the sheathing in a spaced relationship from the rough studding. The spacer comprises an elongated cylinder having two or more chordally extending pins which are compressible against springs to depress the pins within the cylinder body and permit insertion through holes in the sheathing. Once inserted through the sheathing, the pins expand under the spring force and bear against the inner surface of the sheathing to prevent axial movement. Conventional fastening means such as a nail or screw is then extended through the interior of the cylinder and driven into underlying studding while the head of the fastening device bears against the outer surface of the sheath to hold it in place.

BACKGROUND OF THE INVENTION

The present invention provides a simple and unique spacer for holding exterior wall panels in a spaced relationship from underlying studding as used in conventional construction and particularly in residential home construction. The invention permits the use of additional thicknesses of wall insulation without requiring increased widths of studding materials thereby conserving the amounts of building materials required while increasing the insulating characteristics of the wall. With rising costs of energy and the ongoing need for conservancy, the use of increased amounts of insulating materials in residential housing walls has become much more common in recent years. To avoid compressing the insulating materials, whereby their insulating effectiveness is decreased, the wall thickness must be increased which may be accomplished through the use of spacers.

DESCRIPTION OF A PREFERRED EMBODIMENT

Figure 1:
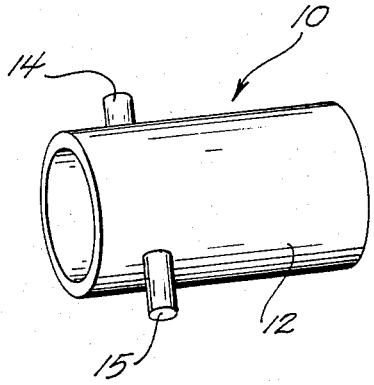
FIG. 1 is a perspective view of a spacer device according to the invention.

As seen in FIG. 1, the spacer device 10 basically comprises a hollow elongated cylinder 12, having a pair of pins 14 and 15 extending chordally outward through opposite sides of the cylinder 12.

Figure 2:
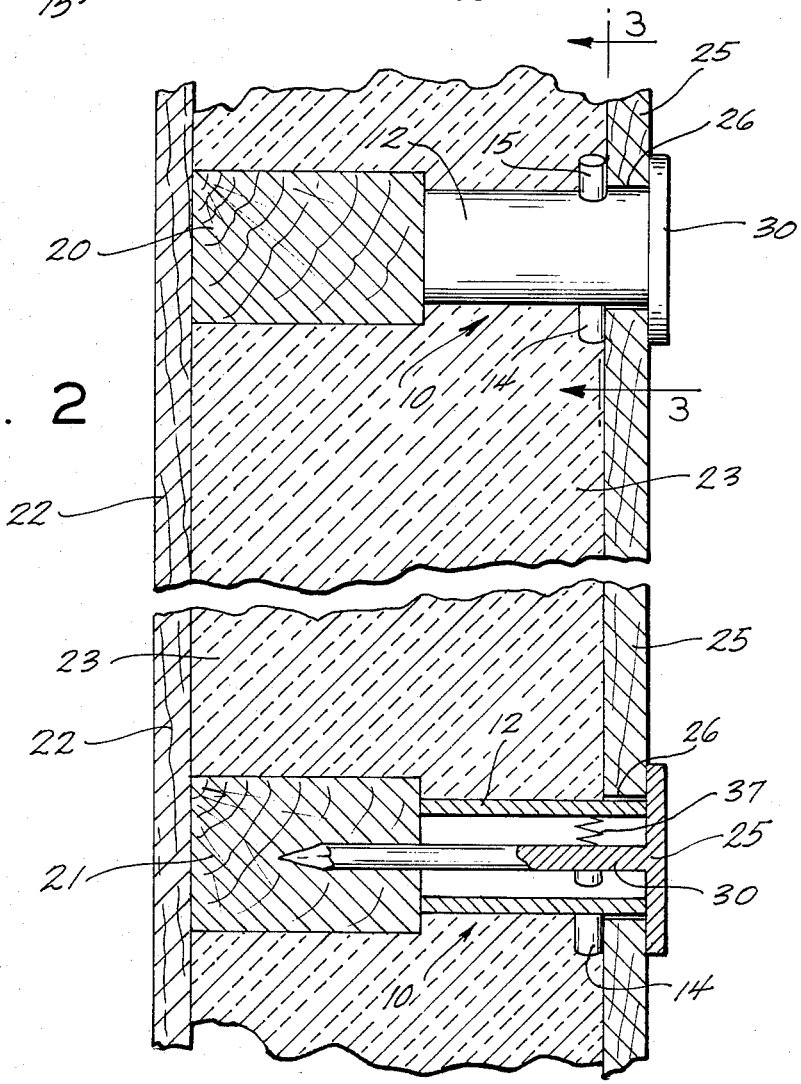
FIG. 2 is a cross-sectional view of the device as used in construction of a wall; and, FIG. 3 is a section view taken along line 3—3 of FIG. 2.

Referring to FIG. 2, a conventional section of a wall is shown which includes standard vertical 2×4 studs 20 and 21 typically placed on 16″ centers. An interior wall 22 is attached to one side of the studs 20 and 21 with insulation material 23 between the studs 20 and 21. Exterior sheathing 25 is held in a spaced relationship from the studs 20 and 21 by use of the spacers 10 thereby increasing the effective wall thickness so that an increased amount of insulation 23 may be used. As shown in FIG. 2, the pins 14 and 15 extend outward from each cylinder 12 and act as stops against the inner surface of the exterior sheathing 25. Pins 14 and 15 are displaced axially from the end of the cylinder to permit a portion of the cylinder between the pins and the end of the cylinder to extend within apertures 26 cut in the sheathing 25. A conventional fastener such as a broad headed nail 30 extends axially through the interior of each of the cylinders 12 and is driven into the studs 20 and 21. The head of the nail 30 will of necessity have a larger diameter than the apertures 26 thereby holding the sheathing 25 securely against the pins 14 and 15 and also securing the cylinders 12 between the studs and the sheathing 25. In FIG. 2 one of the cylinders 12 is shown in a section view for clarity.

Figure 3:
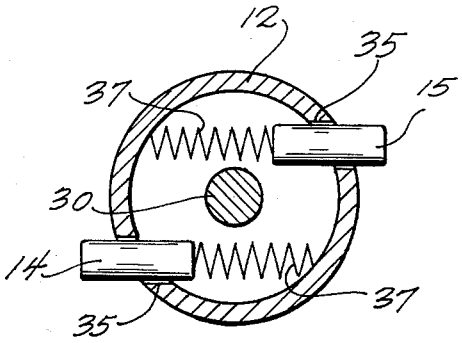

As seen in FIG. 3, the pins 14 and 15 extend chordally through apertures 35 formed in the side walls of cylinder 12. Compression springs 37 are secured between the inner ends of the pins 14 and 15 and the interior surface of the hollow cylinder 12 which permits the pins 14 and 15 to be manually moved into the cylinder against the force of the compression springs 37. The purpose of this will be explained later. Springs 37 may have their ends affixed to the backs of pins 14 and 15 and to the cylinder interior wall by any conventional method such as welding, adhesives or any other suitable fashion.

In practice, the manner of using the invention is quite simple. After rough studding is in place and installation of the exterior sheathing 25 is ready to proceed, the apertures 26 are located within the appropriate portions of the sheathing 25. While holding the sheathing 25 in its intended location, the pins 14 and 15 are depressed to permit insertion of a cylinder 12 through an aperture 26. Once inserted, pins 14 and 15 under the force of springs 37 will extend outward behind the sheathing 25. The fasteners 30 are then driven into the studs to secure the sheathing 25 both axially on the extension cylinder 12, while the portion of cylinder 12 between the pins 14 and 15 and end of the cylinder 12 which extends within the sheathing aperture 26 also serves as a vertical support.

The materials used to construct the invention may be quite varied as will be appreciated by those skilled in the art. Mild steel is preferred because of its relatively low cost and availability as well as its strength although other metals or plastics could be utilized as well. Cylinder 12 may be provided in varying lengths depending upon the amount of additional wall spacing desired, but preferrably is within the 3″ to 6″ range. Similarly the diameter of the cylinder 12 may be varied although it is contemplated that a range of ½″ to 2″ of outside diameter would be normal.

Having thus described the preferred embodiment of the invention, the scope of the invention is not to be limited thereby but is to be taken solely from an interpretation of the claims which follow.

I claim:

1. A spacer device increasing the insulation space within hollow building walls, which walls comprise a first planar surface affixed to one or more supporting members, and a second planar surface spaced from the first planar surface with the support members between them to form a space for containing insulating materials, said spacer device comprising:

a. a hollow cylinder having a first end engaged with one of said supporting members and a second end placed in an aperture formed in said second planar surface;

b. two or more pin means extending chordally through apertures formed in the side wall of said cylinder, said pin means being located intermediate the first and second ends of said cylinder; and, c. compression spring means attached to each said pin means and to the inner surface of said cylinder for biasing said pin means to a first position outside said cylinder to form a bearing surface for engaging said second planar surface, said pin means being compressible against said spring means to permit movement of said spring means to a second position within said cylinder whereby the spacer device may be inserted through the aperture in the second planar surface into engagement with one of said support members and the pin means released to retain the spacer device within said wall space.

2. A spacer device as recited in claim number 1 wherein said pin means having their axes extending along parallel cords within said hollow cylinder and said spring means comprise compression springs having one end attached to the interior of said cylinder with their opposite ends in engagement with the end of said pin means, said springs having a dimensional relationship to the interior diameter of said cylinder in a relaxed condition such that said springs will be wholly contained within the confines of the interior diameter so as to retain said pins in said first position extending through the apertures in the side wall of said cylinder and whereby said pin means may be compressed against said springs to said second position.

* * * * *